US009689093B2

(12) United States Patent
Hamer et al.

(10) Patent No.: US 9,689,093 B2
(45) Date of Patent: Jun. 27, 2017

(54) KNITTING APPARATUS

(71) Applicants: Kathleen Sue Hamer, Wood Heights, MO (US); Frank Allan Hamer, Wood Heights, MO (US)

(72) Inventors: Kathleen Sue Hamer, Wood Heights, MO (US); Frank Allan Hamer, Wood Heights, MO (US)

( * ) Notice: Subject to any disclaimer, the term of this patent is extended or adjusted under 35 U.S.C. 154(b) by 0 days.

(21) Appl. No.: 14/953,896

(22) Filed: Nov. 30, 2015

(65) Prior Publication Data

US 2017/0152614 A1 Jun. 1, 2017

(51) Int. Cl.
*D04B 5/00* (2006.01)
*D04B 3/00* (2006.01)

(52) U.S. Cl.
CPC ..... *D04B 3/00* (2013.01); *D04B 5/00* (2013.01)

(58) Field of Classification Search
CPC ..... D04B 33/00; D04B 17/00; D04B 17/02; D04B 17/04; D04B 3/02; D04B 3/00; D04B 5/00
USPC ..... 66/1 R, 3, 4, 117, 118
See application file for complete search history.

(56) References Cited

U.S. PATENT DOCUMENTS 234,371 A * 11/1880 Benjamin ..... D05B 85/00 223/102
324,030 A * 8/1885 Kratz ..... D05B 85/00 223/102
418,393 A * 12/1889 Bosworth ..... D05B 85/00 223/103
629,074 A * 7/1899 Hatch ..... D05B 85/00 223/103
1,045,998 A * 12/1912 Merrill ..... D05B 85/00 223/103
1,536,274 A * 5/1925 Semonsen ..... D04B 17/04 66/117
1,580,859 A * 4/1926 Schulze ..... D05B 85/02 223/102
1,692,583 A * 11/1928 Shepperack ..... D04B 17/04 66/117
1,704,790 A * 3/1929 Cook ..... D04B 17/04 66/117
1,801,691 A * 4/1931 Ripper ..... B21G 1/00 163/5
2,274,572 A * 2/1942 Yates ..... D04B 17/04 66/117
2,450,067 A * 9/1948 Wolff ..... D04B 39/00 66/4

(Continued)

*Primary Examiner* — Danny Worrell
(74) *Attorney, Agent, or Firm* — Dunlap Bennett & Ludwig PLLC

(57) ABSTRACT

A loom knitting apparatus that enables the user to complete the action of creating a purl or knit stitch on a loom in one fluid step, thereby speeding up the knitting process is provided. The knitting apparatus may include a handle coupled to an arm extending therefrom along a longitudinal axis. The distal end of the arm provides a first hook portion and a second hook portion, wherein the hook portions diverge away from each other along a shared plane, forming supplementary angles relative to the longitudinal axis. The angle of each hook portion is less than or greater than a right angle relative to the longitudinal axis by a predetermined range so as to enable the manipulation of knitting stitches and working stands in the one-step formation of the purl or knit stitches on the loom.

6 Claims, 3 Drawing Sheets

(56) References Cited

U.S. PATENT DOCUMENTS

| | | | | | |
|---|---|---|---|---|---|
| 2,541,543 | A * | 2/1951 | Perhacs | D05B 85/00 | 223/102 |
| 2,703,482 | A * | 3/1955 | Auran | D04B 3/00 | 66/4 |
| 3,346,151 | A * | 10/1967 | Cameron | D05B 85/02 | 223/104 |
| 3,860,155 | A * | 1/1975 | Migliaccio | D04G 3/02 | 223/104 |
| 3,893,603 | A * | 7/1975 | Rush | D04G 3/02 | 223/104 |
| 4,393,668 | A * | 7/1983 | Leach, Sr. | D04B 5/00 | 66/4 |
| 4,413,847 | A * | 11/1983 | Doyel | D04G 3/02 | 289/17 |
| 4,540,108 | A * | 9/1985 | Campbell | D05C 1/00 | 112/80.06 |
| 7,621,228 | B2 * | 11/2009 | Pryce | D04B 3/02 | 112/169 |

* cited by examiner

FIG.5
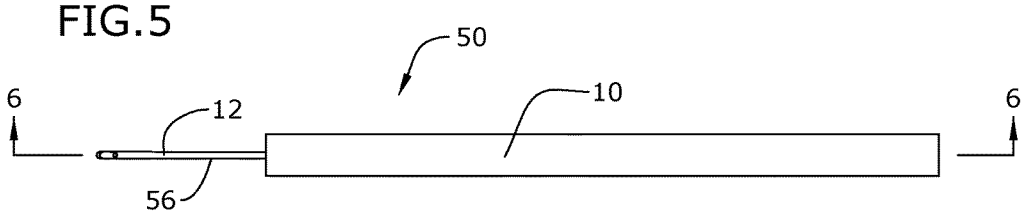
FIG.6
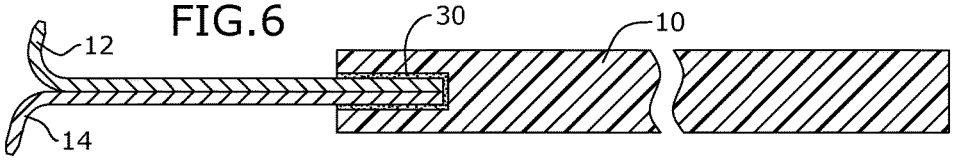
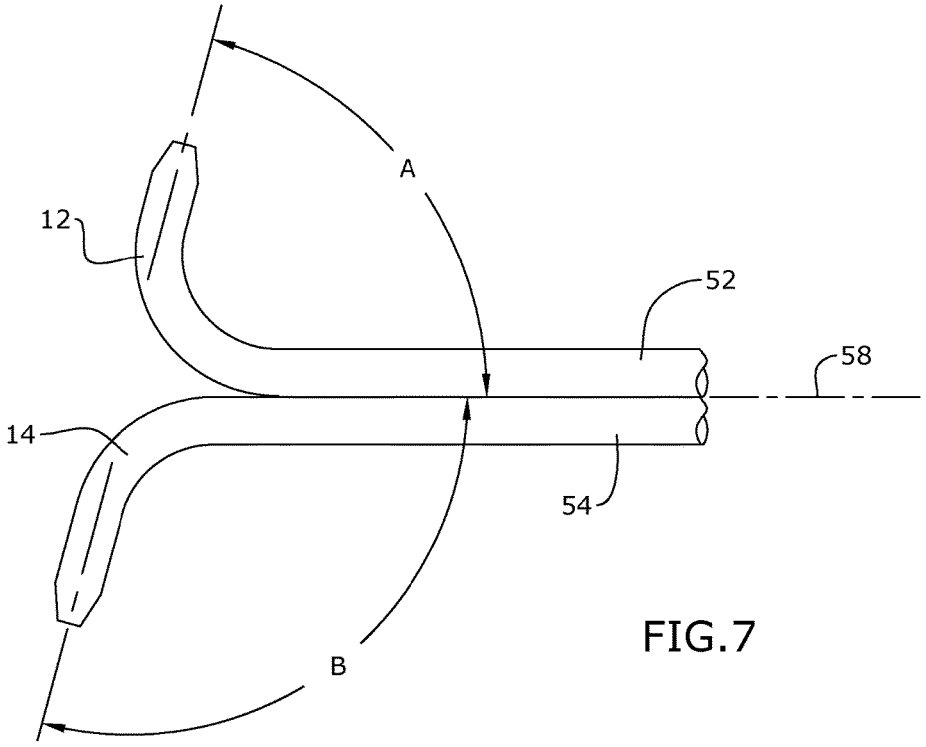
FIG.7

KNITTING APPARATUS

BACKGROUND OF THE INVENTION

The present invention relates to knitting apparatuses and, more particularly, to a knitting tool for knitting with a loom.

In principle there are two general types of hand knitting devices. The first, and most commonly employed, is knitting needles; the other utilizes a loom and a hook device, such as a stitch lifter, to stitch yarn or other fabric strands looped on the pegs of the loom. Knitters seeking to expedite their knitting use the loom. However, using a loom can also be time-consuming, especially if space is limited, wherein the user is typically required to manipulate the loom and the hook device while fitting in the space provided, for example when using a sock loom.

Moreover, the hook devices require a two turn process which results in stress being applied to the wrists of the user for every stitch formed. Specifically, current hook devices require the user to grab an old stitch away from a peg of the loom by orienting their wrist in a first orientation, and then using the hook device to grab hold of a separate working strand for turning the hook device and thus their wrist approximately 180 degrees in order to create one new stitch, and then turning their wrist back to the first orientation to create the next new stitch.

As can be seen, there is a need for a loom knitting tool that enables the user to complete the action of creating a purl or knit stitch on a loom in a fluid motion that does not require the user to substantially turn their wrist.

SUMMARY OF THE INVENTION

In one aspect of the present invention, a loom knitting apparatus dimensioned and adapted to operatively engage knitting strands cast on a handheld loom includes a handle portion extending along a longitudinal axis; an arm portion extending from the handle portion along the longitudinal axis; a first hook portion coupled to a distal end of the arm; and a second hook portion coupled to the distal end of the arm portion, wherein the first and second hook portions diverge along a shared plane so as to form two supplementary angles relative to the longitudinal axis.

In another aspect of the present invention, a loom knitting apparatus dimensioned and adapted to operatively engage knitting strands cast on a handheld loom includes a handle portion extending along a longitudinal axis; a first arm portion and a second arm portion, both extending from the handle portion so as to be joined along the longitudinal axis; a first hook portion coupled to a distal end of the first arm portion; and a second hook portion coupled to a distal end of the second arm portion so that the first and second hook portions diverge along a shared plane forming two supplementary angles relative to the longitudinal axis, wherein the two supplementary angles comprise a first angle and a second angle, and wherein the first angle is less than a right angle by approximately ten to fifteen degrees.

These and other features, aspects and advantages of the present invention will become better understood with reference to the following drawings, description and claims.

BRIEF DESCRIPTION OF THE DRAWINGS

FIG. 5 is a top view of an exemplary embodiment of the present invention;

FIG. 6 is a section view of an exemplary embodiment of the present invention, taken along line 6-6 in FIG. 5; and FIG. 7 is an enlarged view of an exemplary embodiment of the present invention.

DETAILED DESCRIPTION OF THE INVENTION

Figure 1:
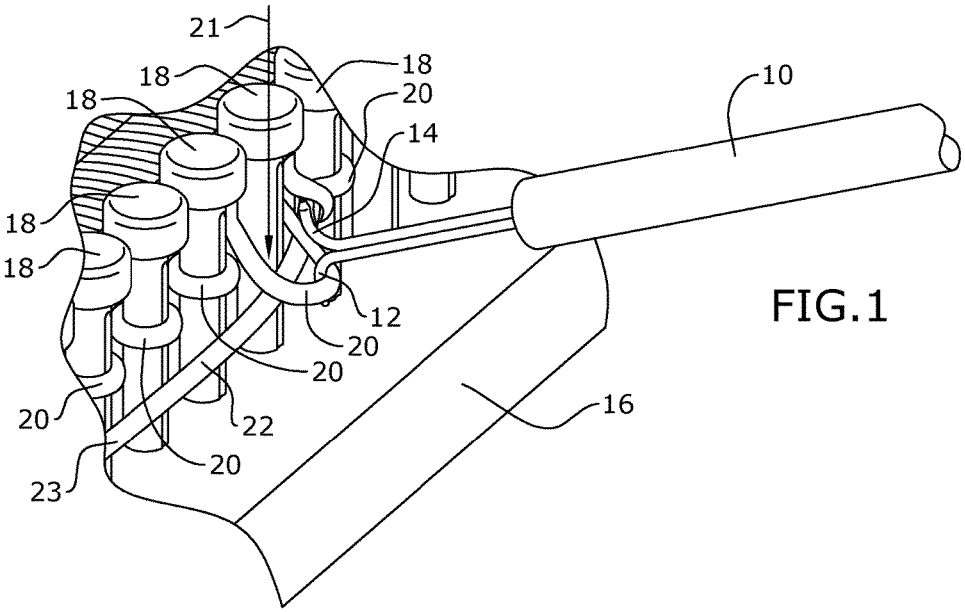
FIG. 1 is a perspective view of an exemplary embodiment of the present invention, illustrating a method of use.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a loom knitting apparatus that enables the user to complete the action of creating a purl or knit stitch on a loom in one fluid step, thereby speeding up the knitting process. The knitting apparatus may include a handle coupled to an arm extending therefrom along a longitudinal axis. The distal end of the arm provides a first hook portion and a second hook portion, wherein the hook portions diverge away from each other along a shared plane, forming supplementary angles relative to the longitudinal axis. The angle of each hook portion is less than or greater than a right angle relative to the longitudinal axis by a predetermined range so as to enable the manipulation of knitting stitches and working stands in the one-step formation of the purl or knit stitches on the loom.

Referring to FIGS. 1-7, the present invention may include a knitting apparatus 50 for knitting on a loom 16. The loom 16 may include a frame having a plurality of pegs 18 projecting from the frame in a suitable pattern, for example in a row pattern, plurality of rows, zig-zag, and the like. The knitting apparatus 50 may include an elongated handle portion 10 having an arm portion 56 extending from the handle portion 10 generally along a longitudinal axis 58 thereof. The handle portion 10 may form a cavity into which the arm portion 56 may be secured with an adhesive or other suitable fastener 30. The handle portion 10 may be made of any suitable rigid material, such as wood, plastic, metal or the like.

A first hook portion 12 and a second hook portion 14 may be disposed near a distal end of the arm portion 56. In certain embodiments, the arm portion 56 may include a first arm portion 52 and a second arm portion 54 running in parallel, wherein a distal end of the first arm portion 52 is coupled to the first hook portion 12 and wherein a distal end of the second arm portion 54 is coupled to the first hook portion 14. The first and second hook portions 12, 14 may diverge from each other along a shared, as illustrated in FIGS. 6 and 7. The first hook 12 portion may form a first angle A relative to the longitudinal axis 58 along the shared plane, while the second hook portion 14 may for a second angle B relative to the longitudinal axis 58 of the arm portion 56, as illustrated in FIG. 7. The first and second angle A, B combined may total 180 degrees, yet angles A and B are less than or more than 90 degrees within a range of five to fifteen degrees. In other words, angles A and B supplementary angles relative to the longitudinal axis 58, but neither angle is 90 degrees relative to the longitudinal axis 58. In certain embodiments, the first angle A is approximately 80 degrees, while the second angle B is 100 degrees. In an alternative embodiment, the first angle A is approximately 75 degrees, while the second angle B is 105 degrees.

There may be a curvature 11 to the second hook portion 14, wherein the curvature 11 is adapted and dimensioned to grasp a knitting strand, such as yarn, when creating a new stitch. The arm portion 56 and first and second hook portions 12, 14 may be made from any suitable material to prevent non-suitable bending. In certain embodiments, the arm portion 56 may extend 1¼" from the handle portion 10.

In operation, the first hook portion 12 may be adapted to grab an existing stitch loop 20, by flexing the wrist either up or down, so as to pull the stitch loop 20 toward the user, as illustrated in FIG. 1. While the first hook portion 12 grabs the existing stitch 20, the second hook portion 14 may be adapted to grab and urge a separate working strand 22 through the pulled existing stitch loop 20, thereby forming a new stitch loop 24 and a new finished knit or purl stitch 28.

Referring to FIGS. 1-4, a method of using the present invention may include the following. The knitting apparatus 50 and the loom 16 disclosed and described above may be provided. A knitting strand 23, such as yarn or any other suitable material for knitting, is also provided. The knitting strand 23 is cast on the plurality of pegs 18 forming a stitch loop 20 on each peg 18, as illustrated in FIG. 1.

After the knitting strand 23 has been cast around the pegs 18, forming the plurality of stitches loops 20, the remaining portion of knitting strand 23 may be working strand 22. The working strand 22 may extend from one of the plurality of pegs 18 so as to be disposed in front of or behind the plurality of pegs 18 having existing stitches loops 20; for example, FIG. 1 illustrates the working strand 22 extending in front of the plurality pegs. In certain embodiments, a cinch loop may be cast around the one of the plurality of pegs 18 wherein the knitting strand 23 is tucked through the cinch loop securing the remaining working strand 22. The disposition of the working strand 22 in front or behind the plurality of pegs 18 may be adjusted during the knitting process so as to influence the types of finished knit stitch 28 formed, knit or purl stitch.

Figure 2:
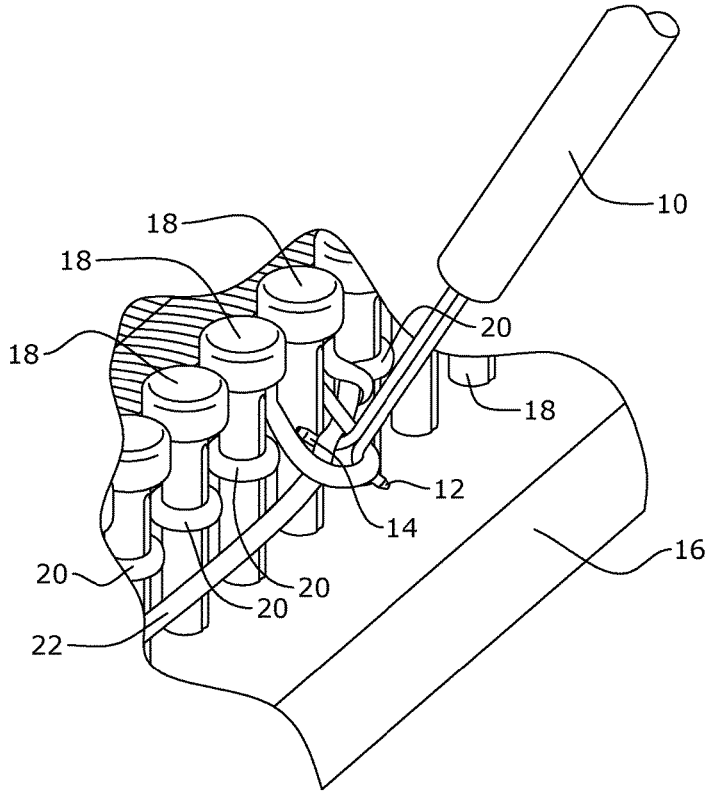
FIG. 2 is a perspective view of an exemplary embodiment of the present invention, illustrating a method of use.
Figure 3:
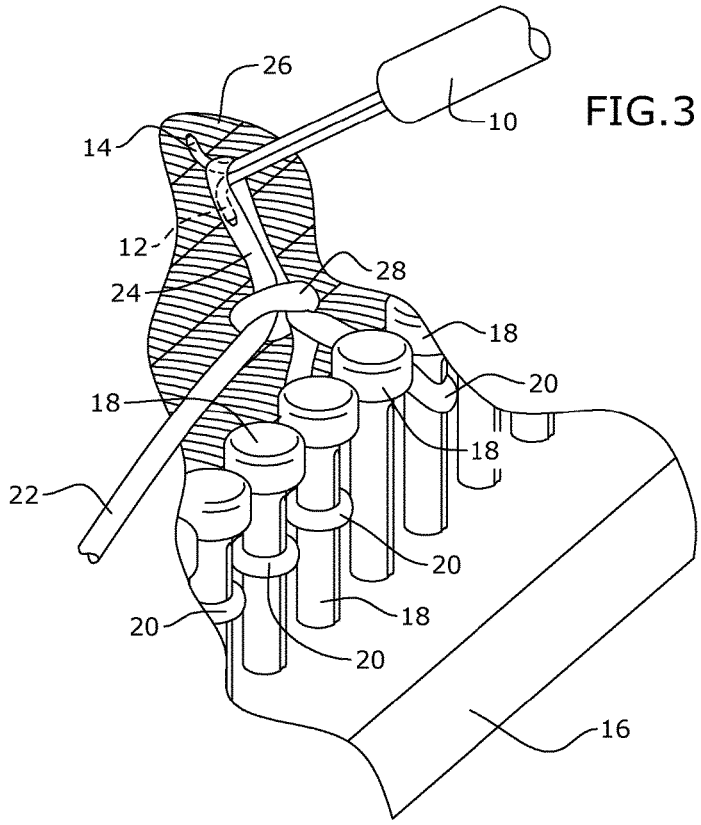
FIG. 3 is a perspective view of an exemplary embodiment of the present invention, illustrating a method of use.

Utilizing the knitting apparatus 50, an existing stitch loop 20 may be pulled off of an associated peg 18 by using the second hook portion 12, forming an access slot 21 between the existing stitch loop 20 and the associated peg 18, as illustrated in FIG. 1. The second hook portion 14 may be manipulated by a turn of the user's wrist to extend into the access slot 21 so as to grab and draw a portion of the working strand 22 through the access slot 21, forming a finished knit/purl stitch 28 combined with a new stitch loop 24 and the remaining working strand 22, as illustrated in FIGS. 2 and 3. While the knitting apparatus 50 is engaged with creating new stitch loops 24, the other hand of the user may be used to apply a desired tension in the working strand 22 by manually applying and relieving the tension thereof.

Figure 4:
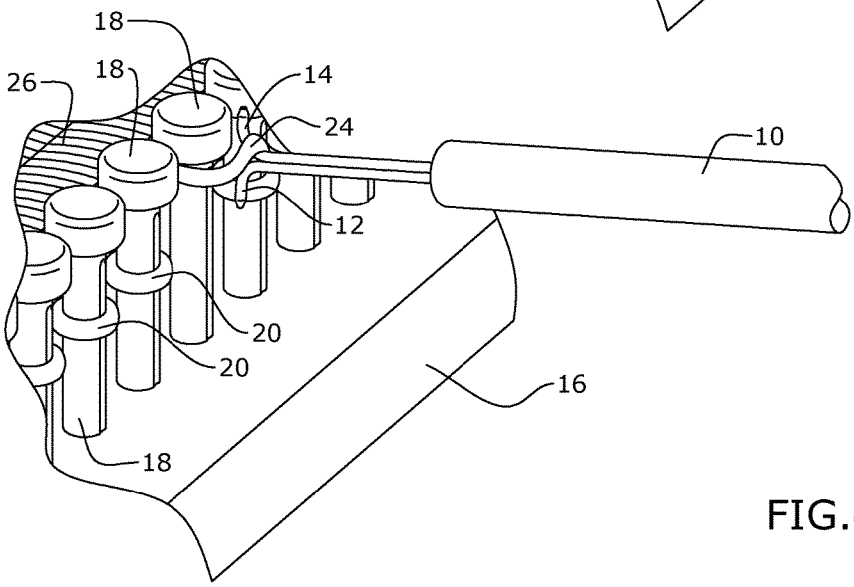
FIG. 4 is a perspective view of an exemplary embodiment of the present invention, illustrating a method of use.

In the process of forming the new stitch loop 24, the existing stitch loop 20 slidingly transitions from the first hook portion 12 as the new stitch loop 24 on the second hook portion 14 is then placed on the associated peg 18 so that the finished knit/purl stitch 28 stitch can be remain off the associated peg 28 of the new stitch loop 24, as illustrated in FIG. 4. It is the less than 90 degree first angle A that enables the initial grabbing of the existing stitch loop 20 yet also enables the subsequent sliding transition during the immediately above-mentioned formation of the new stitch loop 20. And it is the more than 90 degree second angle B that enables the initial urging of the working strand 20 through the access slot 21 yet also enables the subsequent placement of the new stitch loop 24 on the associated peg 18.

If this process is continued, moving from one end peg 18 to the other, the sequentially finished knit/purl stitch 28 lifted off the pegs 18 form a portion of a knitted material 26. By repeating this process the knitted material 26 is formed in a predetermined pattern, such as stitches for patterning scarves, hats, sweater, socks, jackets, blankets, etc.

It should be understood, of course, that the foregoing relates to exemplary embodiments of the invention and that modifications may be made without departing from the spirit and scope of the invention as set forth in the following claims.

What is claimed is:

1. A loom knitting kit, comprising:

a handheld loom providing a plurality of knitting pegs; and a knitting apparatus comprising:

a handle portion extending along a longitudinal axis;

an arm portion extending along a shared plane from the handle portion along the longitudinal axis;

a first hook portion coupled to a distal end of the arm portion; and a second hook portion coupled to the distal end of the arm portion, wherein the first and second hook portions diverge from each other by approximately 180 degrees along the shared plane, wherein a first angle between the first hook portion relative to the longitudinal axis is less than 90 degrees, and wherein each hook portion is adapted to engage a strand extending between at least two of the plurality of knitting pegs.

2. The loom knitting kit of claim 1, wherein the arm portion further comprises a first arm portion and a second arm portion joined along the longitudinal axis, wherein the first arm portion terminates in the first hook portion and the second arm portion terminates in the second hook portion.

3. The loom knitting kit of claim 1, further comprising:

a cavity formed in the handle portion for receiving the arm portion; and an adhesive disposed in the cavity, wherein the adhesive secures the arm portion in the cavity.

4. The loom knitting kit of claim 1, wherein the first angle is less than a right angle by approximately ten to fifteen degrees.

5. The loom knitting kit of claim 4, wherein the first angle is 75 degrees.

6. The loom knitting kit of claim 4, wherein the first angle is 80 degrees.

* * * * *